US005511705A

United States Patent [19]

Dreszer

[11] Patent Number: 5,511,705

[45] Date of Patent: Apr. 30, 1996

[54] INTERCHANGEABLE TOOL AND FASTENER CARRYING AND STORAGE SYSTEM

[76] Inventor: George C. Dreszer, 51 Baldy Ave., Severna Park, Md. 21146

[21] Appl. No.: 384,646

[22] Filed: Feb. 6, 1995

[51] Int. Cl.[6] ..... A45F 5/00

[52] U.S. Cl. ..... 224/252; 224/151; 224/904; D3/228

[58] Field of Search ..... 224/151, 191, 224/224, 225, 226, 234, 240, 247, 248, 251, 252, 269, 270, 271, 272, 904; D3/228

[56] References Cited

U.S. PATENT DOCUMENTS

| | | | |
|---|---|---|---|
| D. 280,258 | 8/1985 | Miller | D3/228 |
| D. 314,670 | 2/1991 | Schultz | D3/228 |
| 3,157,927 | 11/1964 | Roden | 224/248 |
| 4,598,027 | 7/1986 | Johnson | 224/904 |
| 4,790,461 | 12/1988 | Stover | 224/904 |
| 4,830,247 | 5/1989 | Banks | 224/247 |
| 5,176,302 | 1/1993 | Smith | 224/904 |
| 5,361,950 | 11/1994 | Signal et al. | 224/151 |

*Primary Examiner*—William A. Cuchlinski, Jr.
*Assistant Examiner*—Gregory M. Vidovich
*Attorney, Agent, or Firm*—Sughrue, Mion, Zinn, Macpeak & Seas

[57] ABSTRACT

A portable device selectively operable as a tool and fastener caddie and storage device for clipping onto a trademan's work/utility belt or for storing tools and fasteners, with the device detached from the belt.

15 Claims, 5 Drawing Sheets

FIG. 2
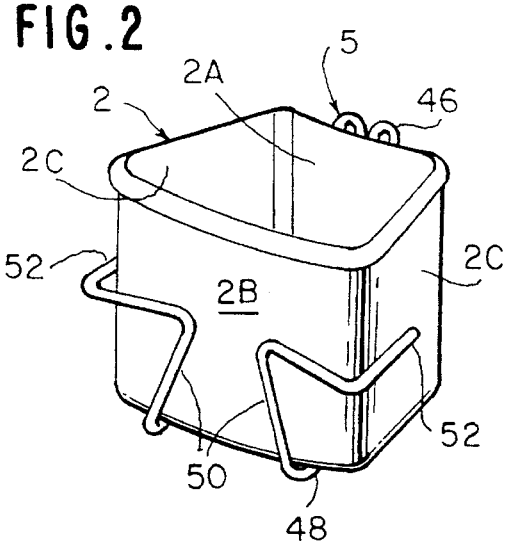
FIG. 3
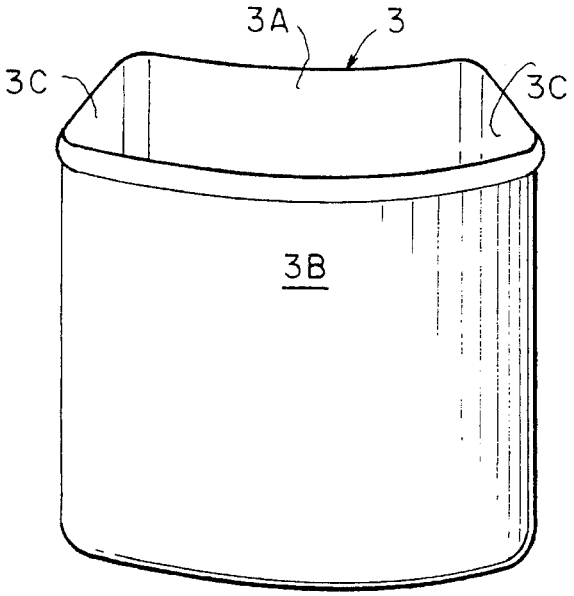
FIG. 4
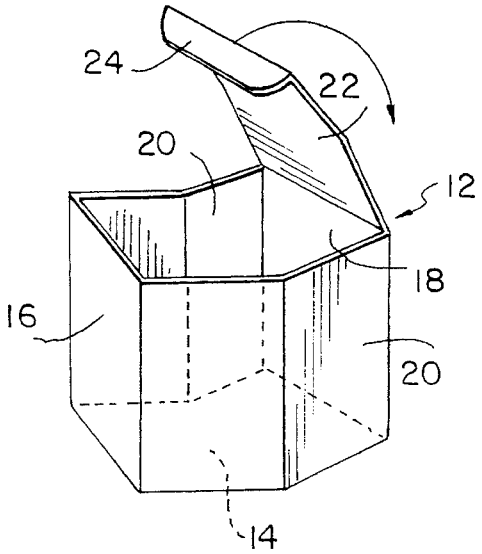
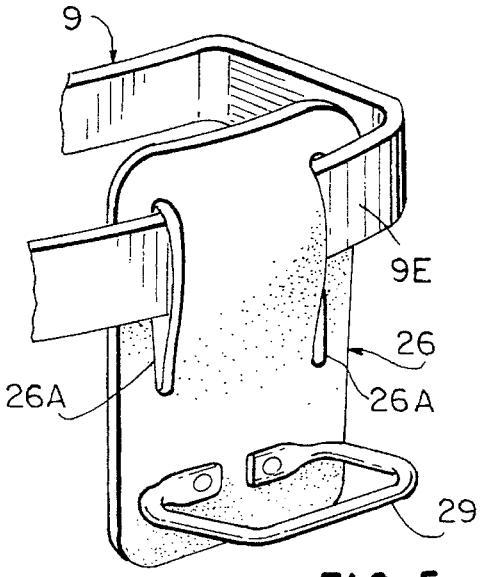
FIG. 5
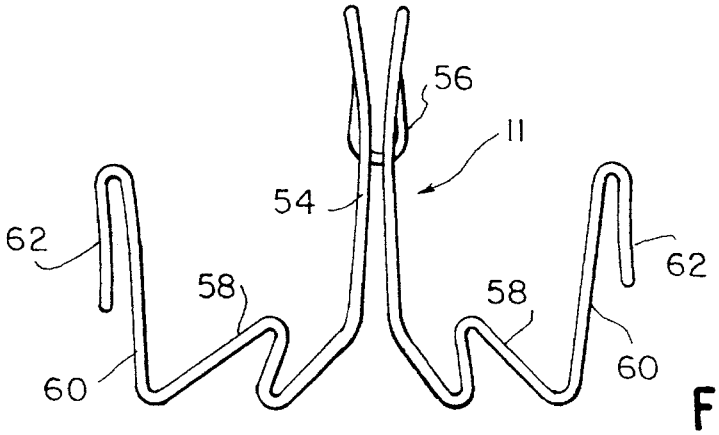
FIG. 6

INTERCHANGEABLE TOOL AND FASTENER CARRYING AND STORAGE SYSTEM

FIELD OF THE INVENTION

This invention relates to the field of tool belts and nail aprons for carpenters, electricians and like tradesmen, and more particularly to a portable tool and fastener caddie and storage device for clipping onto a tradesman's work/utility belt and for storing the tools and fasteners, with the system operating as a caddie when detached from the workman's tool belt.

BACKGROUND OF THE INVENTION

The tradesman typically fastens tools by hanging the same on a tool belt about the tradesman's waist. Additionally, it is known to wear a nail apron which hangs from the workman's neck, fastens about the waist and includes a number of upwardly open pockets spaced peripherally about the apron for carrying nails, screws and like fasteners. Such prior art arrangements are found within a number of U.S. patents.

U.S. Pat. Nos. 1,270,158; 2,664,231; 2,956,715; 3,212,688 and 4,790,461 teach single or multiple tool holders which are belt supported and hung by a clip or the like from a tradesman's belt. Pouches for holding fasteners or tools are shown in U.S. Pat. Nos. 1,201,159 and 1,292,728. U.S. Pat. No. 4,303,188 teaches a caddie for knives. U.S. Pat. No. 4,953,764 is directed to a hinged lid box or caddie for nails, screws carried by multiple detachable containers. U.S. Pat. Nos. 4,932,576 and 4,936,499 teach wire tool holder/nail and screw pouch assemblies supported by a belt passing through the attached wire pouch holders. Tool holders formed of wire, which are belt supported, are found within U.S. Pat. Nos. 4,321,755 and 4,457,462.

None of these references are believed to teach or suggest an interchangeable tool and fastener carrying and storage system functioning alternatively as a suspended tool and fastener carrying structure supported by a tradesman's belt and as an upright storage system caddie.

SUMMARY OF THE INVENTION

The present invention is directed to an interchangeable and fastener carrying and storage system comprised principally of a support frame which disperses the weight, with the weight supported at the waist of the tradesman and additionally at the upper thigh, with the frame being easily detachable from the belt and incorporating an open frame structure which converts to a storage caddie for maintaining the support frame in an upright position when placed on the ground or like surface. The system includes support brackets or hanger clips, either of bent wire or molded plastic which are removable and interchangeably mounted on a multiple transverse rail structure forming components of the support frame for allowing the removal, addition and changing of similarly configured and variably sized pouches. The support frame may receive nested cartons which temporarily store fasteners and the like. The support frame is a generally rigid open frame structure including at least one rear upright riser terminating at an upper end and at least one rearwardly offset, downwardly projecting hook for detachably attaching the frame to the tradesman's work/utility belt. The riser terminates at a lower end in a forwardly projecting horizontal shelf, with the shelf functioning as a horizontal support for rendering the open frame structure freestanding when not suspended from the tradesman's waist.

The open frame structure additionally includes a transverse top rail fixedly mounted thereto and extending to opposite sides beyond the sides of the riser. At least a portion of the top rail is in the form of a closed loop which is matched by a transverse bottom rail fixedly mounted to the riser and spaced below the top rail and extending parallel thereto. The bottom rail is generally sized and configured to that of the top rail and is split at its center forming overlapping ends which are detachably coupled together to permit, when open, the reception of a knife or like tool sheath, slidably mounted thereon. The U-shaped pouch hanger clips, formed of wire or of molded plastic, include an upwardly open body portion sized and configured to receive and hold a tool or fastener carrying pouch and each has a hook integral therewith at a top thereof projecting rearwardly and downwardly therefrom for engaging an edge of one of the rails for suspension thereon.

BRIEF DESCRIPTION OF THE DRAWINGS

FIG. 2 is a perspective view of a pouch within a hanger clip of wire form as illustrated in FIG. 1.

FIG. 3 is a perspective view of a large size pouch for mounting to the generally rigid support frame of FIG. 1 via a spring wire hanger clip of FIG. 6.

FIG. 4 is a perspective view of a cardboard closable flap container for nesting within a pouch such as that of FIG. 3.

FIG. 5 is a perspective view of a tool sheath slidably mounted to the split lower rail of the support frame of FIG. 1.

FIG. 6 is a modified form of a wire type hanger clip employable in the embodiment of FIGS. 1–5.

DESCRIPTION OF THE PREFERRED EMBODIMENTS

Figure 1:
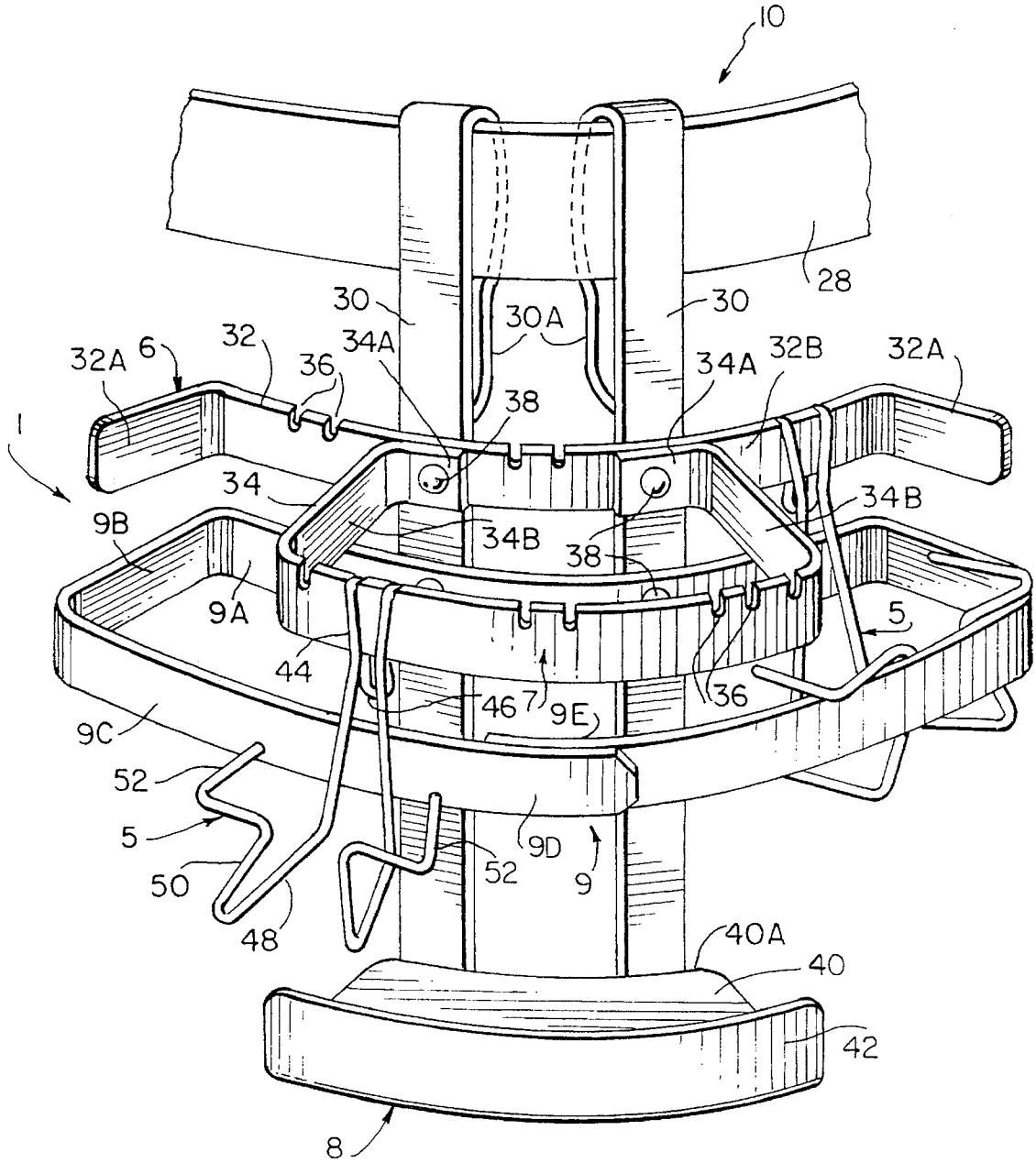
FIG. 1 is a perspective view of an interchangeable tool and fastener carrying and storage system, forming a preferred embodiment of the invention.

Referring to FIGS. 1–6 and 10, a preferred embodiment of the interchangeable tool and fastener carrying and storage system is indicated generally at 10 and is comprised principally of a generally rigid support frame, indicated generally at 1. The frame 1 is of open frame construction and performs a function similar to that of a typical backpack frame. A backpack frame acts to disperse the weight of the pack load evenly and helps to keep the shape of the pack during usage. In this case, the open support frame 1 supports the weight of hand tools and fasteners on the body of the tradesman, decreasing sag and fatigue to both the apron and the tradesman. The open generally rigid frame 1 houses and supports multiple different sizes of pouches such as a small size pouch 2, FIG. 2, and a large size pouch 3, FIG. 3. In accomplishing that function, the open support frame 1 may utilize wire type hanger clips 5 for supporting the small size pouches 2 and the larger size spring wire type clips indicated generally at 11, FIG. 6, for supporting the larger size open top pouches indicated generally at 3, FIG. 3.

Figure 7:
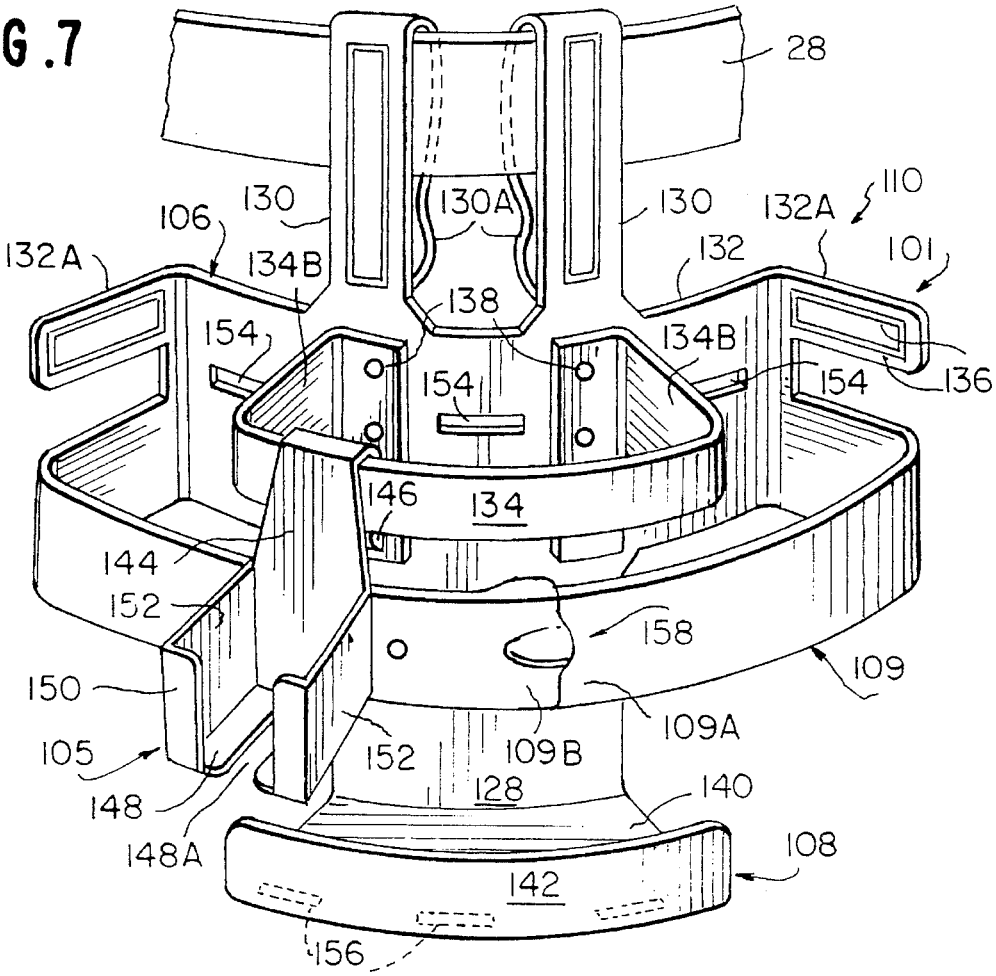
FIG. 7 is a front and top perspective view of an interchangeable tool and fastener carrying and storage system forming a second embodiment of the invention.
Figure 9:
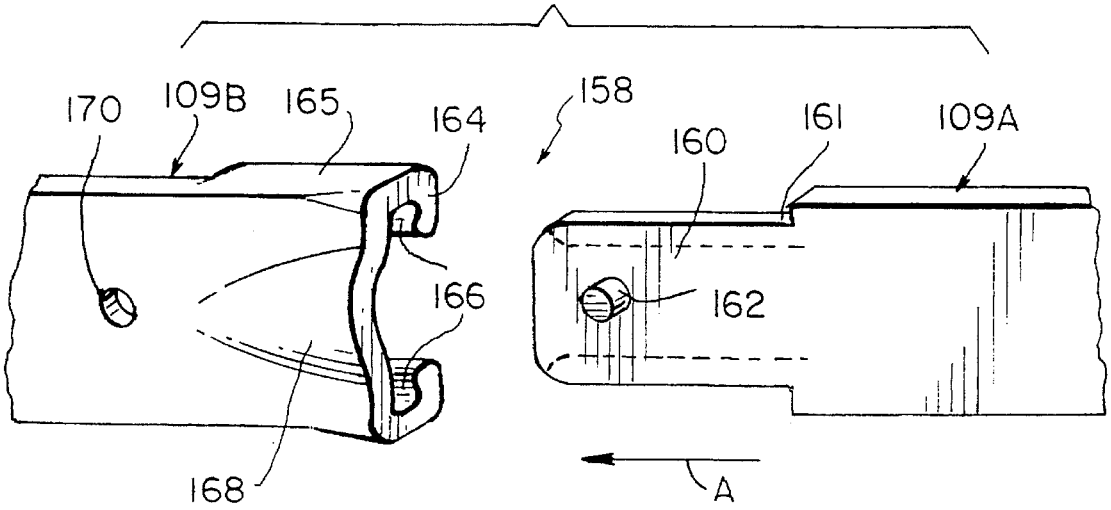
FIG. 9 is an exploded view of a locking arrangement of the split rail of the embodiment of FIG. 7.
Figure 10:
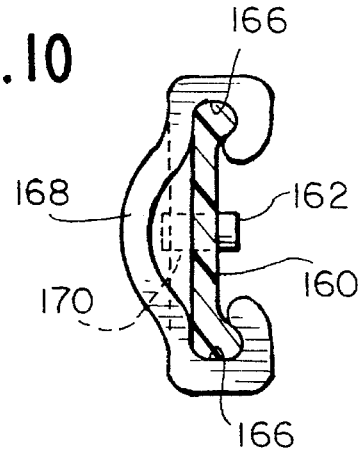
FIG. 10 is a sectional view of the split rail after coupling.
Figure 11:
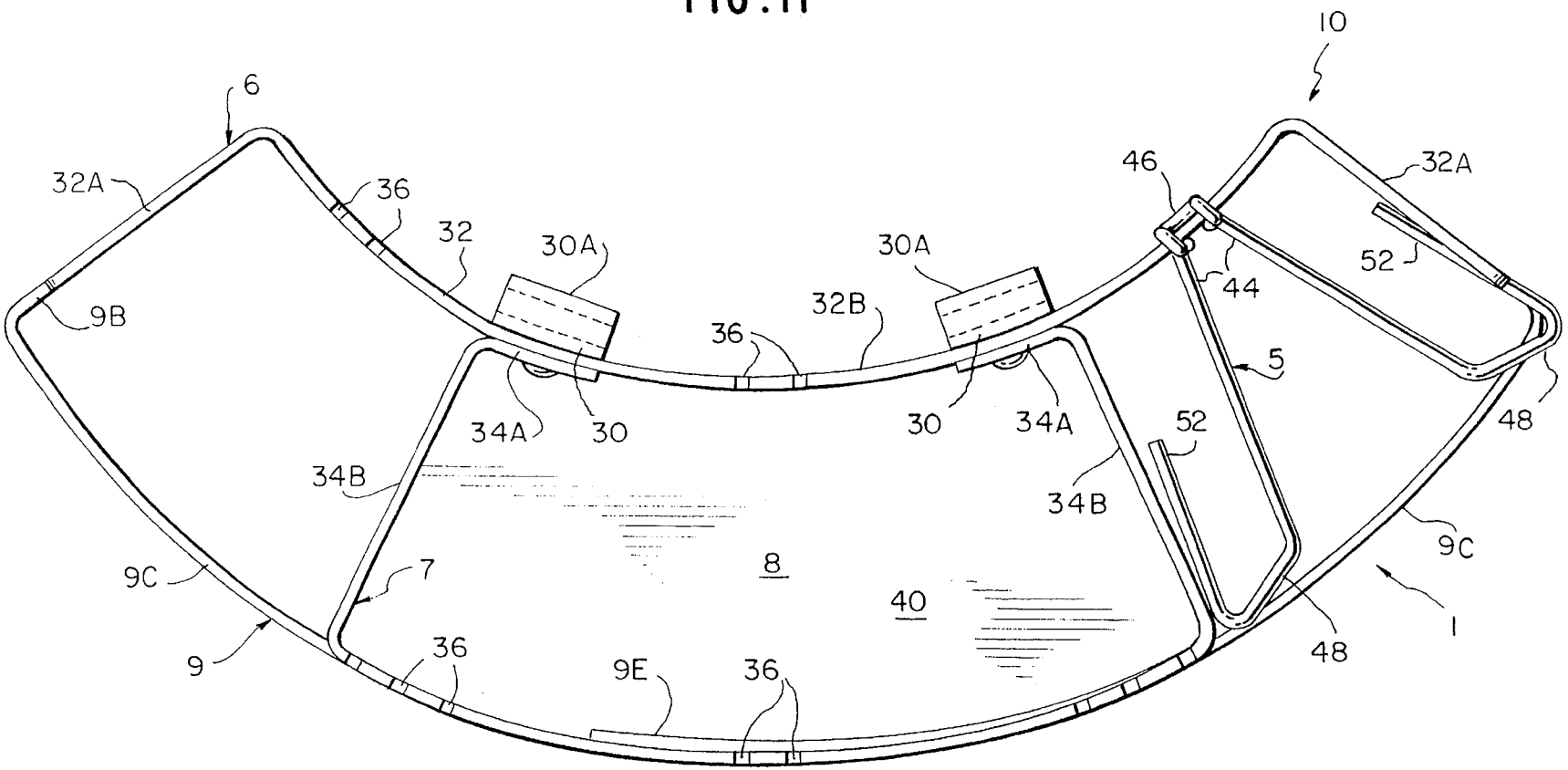
FIG. 11 is a top plan view of the embodiment of invention as shown in FIGS. 1–6.

Referring to FIG. 1, the generally rigid support frame 1 includes a pair of vertical, laterally spaced risers 30 which extend upwardly from an integral horizontal shelf, indicated generally at 8, and particularly from the rear edge 40A of a shelf bottom wall 40 in side-by-side fashion. The elements other than the risers are generally arcuate to conform to the shape of the body of the tradesman wearing the same. The arcuate shelf front wall 42 is elongated horizontally and is preferably integrally molded to the shelf bottom wall 40, extending upwardly from the front edge of that member. The risers 30 may be of molded plastic, integrally molded with the shelf. The risers 30 terminate at their upper ends in integral, reversely directed and rearwardly projecting hooks or clips 30A. As seen in FIG. 1, the clips 30A simply snap fit over the tool belt 28 of the tradesman. Thus, the open support frame 1 is suspended on the tradesman, at the front or to the side of the same. The top rail, indicated generally at 6, includes an arcuate rear rail strip 32 and terminates in wings 32A which are generally at right angles to a central portion 32B of the rear rail strip 32. The top rail 6 is completed by a closed loop front rail strip 34 which is slotted at its rear, having opposed free ends 34A commonly riveted along with the rear rail strip central portion 32B to respective vertical risers 30. Sidewalls 34B of the front rail strip 34 extend generally at right angles to the split rear wall portions 34A with an integral front wall 34C extending arcuately in an arc generally parallel to the rear rail strip 32. At some distance below the top rail 6, a bottom rail 9 of generally arcuate form comprised of a rear wall 9A, laterally opposed sidewalls 9B and a front wall 9C is formed in one piece. The front wall 9C is split into two segments having overlapping ends at 9D, 9E. Coupling or locking means (not shown) in this embodiment are employed for selectively locking the overlapping ends 9D, 9E together after placement of slotted tool carrying sheaths such as that shown in FIG. 5 on the split lower rail 9 as will be seen hereinafter. Such snap coupling arrangement may be in accordance with that of the second embodiment at 110 and as illustrated in FIGS. 7, 9 and 10. The top rail 6 and the lower rail 7 are formed of molded plastic material or the like in strip form, being generally rectangular in cross-section, and being of overall arcuate shape in plan view, as seen particularly in FIG. 10.

In the embodiment of FIG. 1, the top rail 6 includes notches along the upper edge of the rear rail strip 32 and the closed loop front rail strip 34 which extend downwardly from that upper edge as indicated generally at 36 for the reception of hook portions of the bent wire hanger clips as at 5 and 11, respectively, FIGS. 1 and 6. The hanger clips, in turn, act to support the various pouches as at 2, 3, FIGS. 2 and 3, respectively.

As may be appreciated from the drawing FIGS. 1–6, the generally rigid open support frame 1 performs the function of supporting hand tools, either suspended on the frame by sheaths such as that shown in FIG. 5, or various pouches which are suspended from the open frame rails by means of the hanger clips which receive the inserted pouches. In the first embodiment, the hanger clips are wire type hanger clips, while in the second embodiment of FIG. 7, the hanger clips are of molded plastic as is the generally rigid open frame structure forming a principal component of the carrying and storage systems 10, 110, respectively. The wire type hanger clip 5, FIG. 1, is formed of a single piece of spring metal wire which is doubled at its middle and bent to form a generally vertical double wire rear wall portion 44, a rearward, downwardly projecting hook portion 46, a double wire horizontal base portion 48, an upwardly directed double wire front portion 50, and a pair of rearwardly directed, generally horizontal, laterally opposed side arms 52. The hook portion 46 has its double wires received within a pair of laterally spaced notches 36 within the upper edge of front wall 34 of the top rail 6. A pouch such as pouch 2, FIG. 2, may be inserted within that bent wire hanger clip, with the bottom of the pouch contacting the base portion 48 of the wire type hanger clip 5, the rear wall of the pouch 2A abutting the rear wall portion 44 of the hanger clip, the front wall 2B of the pouch engaging the front wall portion 50 of the hanger clip 5, and the side arms 52 of the hanger clip engaging laterally opposed sidewalls 2C of that pouch.

In similar fashion, a larger size wire type hanger clip 11 as shown in FIG. 6 is employable for supporting a larger size pouch after hanging of the same by way of its integral hook onto the rear rail strip 32 of the top rail 6 as per FIG. 1.

FIG. 6 illustrates a variation in the form of the wire type hanger clip. Hanger clip 10 again is formed of a single piece of wire which is bent at its middle to form duplicate halves of the hanger clip to the right and to the left, similar to that of hanger clip 5, FIG. 1. The clip 11 includes a rear wall portion 54 terminating in a rearwardly positioned, downwardly directed hook portion 56. The wire type hanger clip 11 further includes a base portion 58 formed by bending the wire into a pair of zigzags which extend away from each other to the right and left, respectively. The double wire hanger clip 11 terminates in vertical upright legs 60 with reverse bent arms 60 and 62 which project downwardly and may be employed as hooks for engaging the sidewalls of the respective top and bottom rails as at 34B and 9B, when mounted at given positions on the open support frame 1. The large size pouch 3, FIG. 3, which is open at the top and closed at the bottom and defined partially by rear wall 3A, front wall 3B and laterally opposed rearwardly converging sidewalls 3C, may be of a vertical height which is equal to the distance from the shelf bottom wall 40 to the upper edge of the top rail 6. As such, the pouch may be simply inserted within the openings defined by the closed loop front rail strip 34 and the split lower rail 9, to rest on bottom wall 40 of the shelf 8 and confined by those members along with the front wall 42 of the shelf 8.

Because the clips and pouches are detachable, various combinations of placement and types for the pouches are possible. The frame as designed in the illustrated embodiment of FIG. 1 accepts a single large pouch 3 and as many as five small pouches 2 or as many as seven pouches 2 while further suspending various leather or plastic sheaths for tools such as knives, wrenches, hammers, pliers and the like. The large pouch 3 is designed to carry a number of tools easily grasped via the open upper end of the pouch. Multiple tools may be carried, aided in weight handling by the underlying shelf 8, upon which the large pouch 3 rests. Alternatively, a large pouch such as that at 3 may be suspended from the frame by way of a wire hanger clip or a molded plastic hanger clip of the type shown in the embodiment of FIG. 7. As mentioned previously, the horizontal flat bottom wall 40 of the shelf also functions as a base for the frame to permit the frame to act a self-standing unit, i.e., a tool and fastener caddie.

The complete unit or system is easily detached from a standard work belt and may be placed on or mounted to an upright article like an open top bucket, if work is to be performed in a single location for some time such as at a shop work station. In a typical system, the large pouch may be eight inches in height to accommodate larger tools or bulky fasteners and prevents tools from falling out. The small pouches 2 are designed to accommodate fasteners or compact tools such as tape measures, chalk boxes, nail sets, etc. A pouch with one type of fastener may be easily removed by lifting the same from the hanger clip by which it is suspended from the frame 1 to readily accommodate a similar sized pouch containing a different type of fastener. Pouches may be readily added at various locations for a variety of fasteners. The pouches can be removed when not in use to decrease the overall weight of the system. The pouches may be manufactured from various materials such as plastic sheets, particularly foam plastic sheets, typically designated "sheet craft foam". Multiple layers of such sheet craft foam may be adhesively laminated to provide the strength and thickness to wear over extended use. The pouch sidewalls may be of two layers of bonded plastic sheets, whether of foam or other form. The bottoms of the open top pouches 2, 3 may be a four-layer lamination. Such foam plastic comes in a variety of colors, thus the pouches may be color-coded to facilitate storage of fasteners of specific types. Reference to FIG. 4 illustrates at 12 a lightweight, less durable pouch formed as a high strength waxed paper carton having a bottom wall 14, front and rear walls 16, 18 and laterally opposed sidewalls 20, along with an integral lid or cover 22 terminating in an end flap 24. The lid 22 may be folded back, and indeed the carton can be resealed and labeled and kept in storage until that type of fastener is needed. Standard cartons carrying screws, nuts, nails, etc. can be readily supported by the hanger clips at various positions about the exterior of the open support frame structure 1, or may be simply inserted into the open top pouches 2, 3 as desired.

The split lower rail 9 can accommodate a variety of standard tool belt accessories such as tape measure holders, knife sheaths, hammer loops, drill holsters, etc. FIG. 5 shows the placement on the split lower rail section 9E of a hammer loop indicated generally at 26, comprised of a strip of leather bearing two laterally spaced vertical slits 26A at the upper end thereof, while below the strips is riveted thereto, on a front face, a hammer loop 28 of metal sized to permit the handle of a hammer (not shown) to be inserted with the enlarged head of the hammer abutting the metal ring 28 and the handle suspended thereby.

The open, generally rigid support frame 1 may be constructed of molded plastic components or the risers may be formed of one eighth by one inch aluminum bar stock, joined by steel pop rivets with aluminum backer washers to the top and lower rails 6, 9 and the shelf 8, formed of pieces obtained from a plastic drywall joint compound bucket or the like. The wire type hanger clips may be made of various wire or wire rod materials such as galvanized suspended ceiling support wire No. 12. The pouches 2 and 3 may be made of a heavy duty reinforced vinyl plastic, heavy weight rip stop nylon or heavy weight synthetic canvas sewn with heavy duty waxed thread and reinforced with rivets. A strong plastic material resistant to breakage and deformation such as that used in the manufacture of drywall joint compound buckets appears to be adequate for the frame material. Such material could be, for instance, poly vinyl chloride (PVC).

Figure 8:
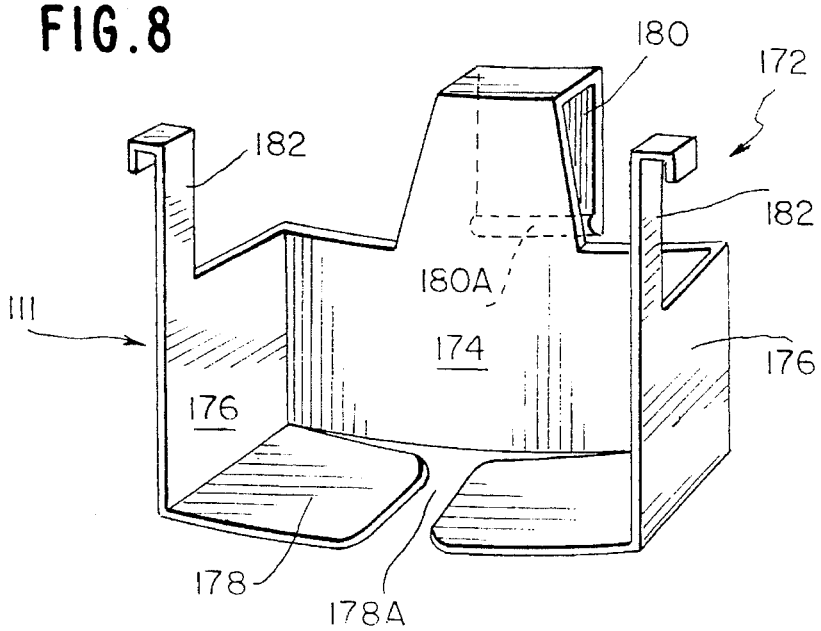
FIG. 8 is a perspective view of a molded plastic double hanger for small pouches for use with the embodiment of FIGS. 1 and 7.

Referring next to FIGS. 7, 8, 9 and 10, there is illustrated a second, preferred embodiment of the invention, in which all components are manufactured of molded plastic. Preferably, the open support frame 101 forming the principal component of the interchangeable tool and fastener carrying and storage system, and indicated generally at 110 is of one piece construction. This embodiment also teaches a variation, in that a double hanger indicated generally at 172, FIG. 8, is inserted within the opening defined by the top rail closed loop rail strip 134, which is riveted by way of rivets 138 to a rear wall 128 of the generally rigid open frame structure 101, just below the laterally spaced risers 130 which terminate in rearwardly positioned, downwardly directed clips or hooks 130A. Two or more small pouches similar to those at 2, FIG. 2, of the first embodiment may be supported by the suspended double hanger 172. The overall configuration and operation of the system 110 is similar to that of the first embodiment, if not identical. The generally rigid open frame 101 is formed of molded plastic material and includes a top rail indicated generally at 106, and a lower rail indicated generally 109, which includes a snap coupling indicated generally 158 for the halves of lower split rail 109. The rear wall 128 of the open support frame 101 at the bottom is integrally molded to a shelf indicated generally at 108. The shelf is formed in the manner of the first embodiment with a bottom wall 140 terminating in an arcuate, vertically upright front wall 142. In this embodiment, a number of laterally spaced, elongated slots 156 are provided within the bottom wall 140 to receive hooks as at 146 of the unitary molded plastic type hanger clip 105. Further, the rear wall 128 includes a cut-out slot 154 and the top rail 6 within the rear rail strip 132 thereof includes two cut-out slots 154. The molded plastic unitary support frame structure may have molded in ribs 136 for additional strength and to limit flexibility of the molded plastic structure.

Of particular interest in this embodiment is the specific nature of the snap coupling 158 for the overlapping ends 109A, 109B of the lower split rail 109. FIGS. 9 and 10 illustrate the makeup of the snap coupling and the nature of uncoupling of the same after receipt of a tool holder such as the hammer loop sketch of FIG. 5. Snap coupling is effected by movement of the two ends 109A, 109B towards each other as evident by arrow A, FIG. 9. The one end 109A terminates in a reduced width male projection 160 forming a shoulder 161 which abuts an end face 164 of the other split end 109B of lower rail 109. The end 109B is thickened at 164 and provided with a pair of upper and lower grooves 166 sized to receive the reduced width projection 160 of the male projection of the lower rail split end 109A. A pin 162 projects outwardly at least from the side of the split end 109A facing that of 109B. Integrally molded into end 109B is a camming groove 168 which tapers so as to cam the pin 162 outwardly, restrained at opposite lateral edges by respective grooves 166. The pin 162 then snaps into a circular aperture or hole 170 in the center of the split 109B to lock or latch the two split ends 109A, 109B together. In order to separate the split rail ends, force must be exerted axially against the pin 162 to move it out of the hole 170, permitting a reverse action pulling of the split end 109A to the right, away from that at 109B.

FIG. 8 illustrates a molded plastic double hanger clip 172 comprised of a molded plastic unitary structure which is box like in configuration, including a rear wall 174, laterally opposed sidewalls 176, an open front 171, and split bottom walls 178 defined by a front-to-rear slot 178A. Integrally molded to the box like structure is a rear hook or clip 180 terminating in a rounded bead edge at 180A which may snap into an elongated horizontal slot 154 within the top rail 106 rear rail strip 132 when the plastic double hanger hinge clip 172 is mounted within the closed loop rail strip 134 as previously described. Similarly, a rearwardly positioned hook 146 of the small pouch molded plastic type hinge clip 105, FIG. 7, snaps under the lower edge of the closed loop front rail strip 134 to securely locate that clip in a position for supporting a small size pouch 2 fitted thereto and received thereby.

As may be appreciated, the molded plastic double hanger clip 111 fits over the upper edge of the sidewalls 134B of the top rail 106 to assist in supporting the load of the pouch carried thereby. In this embodiment, the double hanger clip 172 may not be of a height or depth such that the bottom wall 178 contacts the upper surface of the shelf bottom wall 140 to permit the shelf to absorb most of the load of a large size pouch or multiple small pouches within the double hanger clip 172.

A wire carrying handle of U-shaped form may be employed in carrying the system 1, 101 from work station to work station by simple engagement of horizontal ends of a wire carrying handle within the side-by-side hooks at the upper ends of the risers 130 for the embodiment of FIG. 7 or those at 30 of the first embodiment 1 in similar fashion. Further, the rear walls of the various hanger clips may be extended to physically position the pouches carried thereby at given levels on the open frame structure of both embodiments.

It should be apparent that various modifications may be made to the invention as described with respect to the preferred embodiments without departing from the invention. The open frame structures may be made of molded components which are riveted together or otherwise fixed to each other as for instance by an adhesive. Alternatively, the complete open frame structures may be molded in one piece form. Components may be made of all plastic or some components plastic and others metal. It is intended that the scope of protection be set forth in the claims and not limited to the embodiments illustrated and described in detail herein.

What is claimed is:

1. An interchangeable tool and fastener carrying and storage system comprising a generally rigid, open frame structure, said frame structure including at least one rear upright riser, said at least one riser terminating at an upper end in a rearwardly positioned, downwardly projecting hook adapted for attachment to and suspension on a tradesman's work/utility belt and terminating at a lower end in a forwardly projecting horizontal shelf, with said shelf rendering said frame freestanding when not suspended to said belt, a transverse top rail fixedly mounted to said at least one riser and extending to opposite sides of said riser, at least a portion of said top rail being in the form of a closed loop, a transverse, closed loop bottom rail fixedly mounted to said at least one riser below said top rail and being spaced therefrom and parallel thereto, said bottom rail being generally sized and configured to that of the top rail, a plurality of hanger clips including a U-shaped, upwardly open body portion, each of said clips being sized and configured to receive an item carrying pouch therein, each hanger clip having a hook integral therewith at a top thereof, projecting outwardly therefrom and downwardly thereof for engagement with an edge of one of said rails wherein at least one of said pouches being sized differential than said other pouches and at least one of said hanger clips having a body portion configured to receive said at least one pouch therein, said at least one pouch being selectively supported by at least one of said shelf and said at least one hanger clip wherein said at least one hangar clip is selectively engaged with an edge of one of said rails.

2. The system as claimed in claim 1, wherein said top rail comprises a rear rail strip of generally arcuate form and a closed loop front rail strip having rear portions commonly engaging said rear rail strip and wherein at least one of said rear portions are commonly coupled to said at least one riser and coplanar with said rear rail strip, and wherein said lower rail is of corresponding arcuate form and extends laterally beyond the ends of said closed loop front rail strip of said top rail.

3. The system as claimed in claim 1, wherein said closed loop lower rail is split at a front portion thereof, forming overlapping ends and means are provided for detachably coupling said overlapping ends together, thereby permitting tool sheaths to be slidably mounted thereon for suspension of hand tools within said sheaths on said front portion of said lower rail.

4. The system as claimed in claim 2, wherein said closed loop lower rail is split at a front portion thereof, forming overlapping ends and means are provided for detachably coupling said overlapping ends together, thereby permitting tool sheaths to be slidably mounted thereon for suspension of hand tools within said sheaths on said front portion of said lower rail.

5. The system as claimed in claim 1, further comprising closable cartons sized to said hanger clip body portions and insertably nestable within the same.

6. The system as claimed in claim 1, wherein one of said closed loop rails is split at a portion thereof, forming overlapping rail ends, and wherein one of said rail ends constitutes a male coupling member and said other of said rail ends comprises a C-shaped female coupling member having laterally opposed slots for receiving opposed edges of said male coupling member, respectively and wherein said male member comprises a pin projecting outwardly of a side surface thereof in the direction of a side surface of said female coupling member, wherein said female coupling member includes a circular hole sized to receive the pin and lying in the path of movement of that pin during coupling, and wherein said female member includes camming means for camming said pin away from said female member side surface during insertion of the male member into the female member, thereby causing snap fitting of the pin into the hole to complete coupling between said rail ends.

7. The system as claimed in claim 1, wherein said at least one riser comprises two laterally spaced risers extending parallel to each other and perpendicular to said shelf.

8. The system as claimed in claim 1, wherein said hanger clips are formed of bent wire including a vertical rear wall portion, a horizontal base portion, a vertical front wall portion and laterally spaced horizontal arms forming a body cavity capable of receiving one of said item pouches therein, and wherein said hook is integrally formed with said vertical rear wall portion and extends rearwardly and downwardly thereof, parallel to said rear wall portion.

9. The system as claimed in claim 8, wherein said arms converge from front to rear, and wherein each of said hanger clips carry one of said item pouches having corresponding rearwardly converging sidewalls.

10. The system as claimed in claim 8, wherein at least one of said rails has laterally spaced notches within upper edges of the same sized to and receiving portions of at least one of said wire hanger clips at bend points forming said hooks at the upper ends of said rear wall portion.

11. The system as claimed in claim 1, wherein at least one of said top rail, said lower rail and a bottom wall of said shelf includes at least one elongated horizontal slot, and wherein said hanger clips are formed of molded plastic including a vertical back wall terminating in said hook, and wherein the hook terminates in a forwardly projecting transverse bead sized to and receivable within said at least one horizontal slot, whereby said clips are fixedly positioned and resiliently engaged with the member bearing said at least one horizontal elongated slot to maintain the clip and one of said pouches carried thereby in a relatively fixed position on said frame structure.

12. The system as claimed in claim 11, wherein said at least one horizontal slot comprises a plurality of elongated slots within said top rail.

13. The system as claimed in claim 11, wherein said at least one elongated horizontal slot comprises a plurality of elongated slots within said bottom wall of said shelf proximate to a front wall integrally formed with said shelf.

14. The system as claimed in claim 11, wherein each of said molded plastic clips comprise a vertical rear wall, a pair of laterally opposed spaced sidewalls, a slotted bottom wall and an open front wall, wherein the walls are integral and wherein said vertical back wall is integral with said vertical rear wall.

15. The system as claimed in claim 14, wherein one of molded plastic clips further includes a pair of oppositely directed hooks integral with the opposed sidewalls of said one molded plastic clip and engageable with said top rail, such that the one molded plastic hanger clip is suspended at three points on said top rail to distribute the load of the pouch carried thereby on said frame structure.

* * * * *